US005118265A

United States Patent [19]

Bearss

[11] Patent Number: 5,118,265

[45] Date of Patent: Jun. 2, 1992

[54] LIQUID PUMP ASSEMBLY

[76] Inventor: James G. Bearss, 15164 Ferry Rd., Charlevoix, Mich. 49720

[21] Appl. No.: 608,296

[22] Filed: Nov. 2, 1990

[51] Int. Cl.[5] ..... F04B 21/02

[52] U.S. Cl. ..... 417/534; 417/536; 417/568; 417/454; 137/541; 384/32; 384/42

[58] Field of Search ..... 417/534, 535, 536, 544, 417/568, 454, 199.1, 426; 137/541; 251/368; 384/7, 11, 32, 42

[56] References Cited

U.S. PATENT DOCUMENTS

| | | | |
|---|---|---|---|
| 523,240 | 7/1894 | Rodenbaugh | 417/544 |
| 796,996 | 8/1905 | Gibson | 417/544 |
| 1,539,556 | 5/1925 | Garber | 417/544 |
| 1,641,717 | 9/1927 | Welter | 417/544 |
| 3,727,636 | 4/1973 | Simmons | 137/541 |
| 3,791,775 | 2/1974 | Bocknak et al. | 417/426 |
| 4,013,138 | 3/1977 | McBurnett | 417/426 |
| 4,826,046 | 5/1989 | Rudick | 417/538 |
| 4,890,937 | 1/1990 | Balsells | 384/32 |

FOREIGN PATENT DOCUMENTS 2059955 6/1972 Fed. Rep. of Germany ..... 417/454

*Primary Examiner*—Richard A. Bertsch
*Assistant Examiner*—Charles Freay
*Attorney, Agent, or Firm*—Neil F. Markva

[57] ABSTRACT

A pumping apparatus comprises a piston/cylinder assembly mounted between two laterally spaced end cap sections attached to base means and including spring-loaded valve devices. A piston rod is movably supported in and extends outwardly from one of the end cap sections. A manually operated linkage mechanism effects axial longitudinal movement of the piston rod and a support mechanism maintains longitudinal axial alignment of the piston rod during its longitudinal axial movement. The longitudinal movement of the piston rod operates in concert with the spring-loaded valve devices to pump fluid manually when the pumping apparatus is positioned in any angular disposition with respect to the horizontal.

49 Claims, 2 Drawing Sheets

40
38
65
V
IV
14
14C
44A
44
44A
16C
63
16
44B
44B
55
12B
12A
50C
50D
34B
45A
45
34
46A
46B
12A
12
B
34A
14B
12B
16B
42B
50A
50B
42A
14A
42B
42
42A
16A
64
65
V
IV

43
OUT
50C
14
50A 50D
16
41
50B
IN

LIQUID PUMP ASSEMBLY

FIELD OF THE INVENTION

This invention relates to a liquid pump assembly of the double-acting type. More particularly, this invention is directed to a reciprocating piston/cylinder liquid pumping assembly for maintaining continuous operation of a pressurized liquid pumping system.

BACKGROUND OF THE INVENTION

The use of double-acting force pumps for providing a continuous flow of liquid is generally well known as disclosed by U.S. Pat. Nos. 662,437; 684,740; 710,856; 2,685,257; and 4,253,804.

U.S. Pat. No. 710,856 discloses a double-acting piston pump that must be connected directly over a well and can only be operated in a straight, upright position. This known liquid pumping assembly cannot be used in a pressurized system but pumps water from a well into an open container.

The liquid pumping assembly of U.S. Pat. No. 684,740 is designed only to be placed inside a well and is gravity-operated in only a vertical position.

U.S. Pat. No. 662,437 discloses a gravity-operated pump that must be disposed in a vertical position to properly operate. Such a prior art liquid pumping assembly cannot operate in a pressurized liquid transmission system.

The double-action liquid pump assembly of U.S. Pat. No. 2,685,257 is designed as a primary internal well pump and particularly for use in a deep well rather than a shallow well.

U.S. Pat. No. 4,253,804 discloses a double-action hand pump structure which is not designed to pump into a pressurized system. It is a hand-operated liquid pump assembly useful for fluid transfer and designed to eliminate the use of friction bearing assemblies in its construction.

U.S. Pat. No. 4,736,675 discloses a primary pump designed to be power-driven with a crank shaft having a double-action drive. The guide rod simply prevents the piston rod from turning about its own axis but does not insure the longitudinal alignment of the piston rod.

The liquid pump assembly of U.S. Pat. No. 4,762,051 is a single-acting pump having a double-acting drive. This known pumping assembly has no rod alignment mechanism and its valve assembly produces a result unlike that of the present invention.

The primary purpose of this invention is to produce a liquid pumping assembly which may be used in a pressurized system.

Another object of the invention is to provide a liquid pumping assembly which may be used as a hand-operated standby pump if for any reason a primary pumping assembly loses power.

A further object of the invention is to provide a liquid pumping assembly which is useful in an environment where no electrical power source may be available and can provide a continuous flow of liquid from an outside source into a pressurized system.

Another object of the invention is to provide a pumping assembly having an alignment mechanism for maintaining the axial longitudinal movement of a piston rod that drives a piston member in a reciprocating movement within a cylinder.

A still further object of this invention is to provide a liquid pumping assembly having no seals or packing that will dry out or set up with all the moving parts and surfaces having bearing material effective to maintain alignment of the various moving parts.

Still another object of this invention is to provide a liquid pumping assembly useful for a shallow well and may be installed with bypass valves between the well and a reservoir for regular use or as standby use when a power source is cut off from a primary pumping system.

A further object of this invention is to provide a liquid pumping assembly which may be used for indoor toilets and faucets of a pressurized system where electricity is generally not available such as in hunting cabins, cottages and the like.

Another object of the invention is to provide a liquid pumping assembly that may be fixedly attached to a floor or wall in any position with respect to the horizontal thereby making it adaptable to virtually any environmental situation.

SUMMARY OF THE INVENTION

The liquid pumping assembly of the invention comprises piston means mounted for reciprocating movement within a liquid pumping cylinder. The cylinder is in liquid flow communication at each end thereof with a respective first and second end cap section. Each end cap section includes liquid inlet means, inner chamber means and liquid discharge means. Biasing means maintains the inlet and outlet valve means in a normally closed condition. The inlet valve means is disposed between the liquid inlet means and the inner chamber means of each end cap section. The outlet valve means is disposed between the inner chamber means and the liquid discharge means of each cap section.

Each inlet valve means is effective to allow inlet liquid flow into the pumping cylinder because a suction condition forms in the cylinder behind the piston means as it moves in a pumping direction away from the respective end cap section causing the inlet valve means to open. Each outlet valve means is effective to allow outlet liquid flow from the pumping cylinder because a pressurized condition forms in the cylinder ahead of the piston means as it moves in a direction toward the respective end cap section causing the outlet valve means to open.

The pumping apparatus of the invention is for use with a pressurized system and comprises a piston/cylinder assembly mounted between two laterally spaced end cap sections attached to base means. The piston/cylinder assembly includes piston rod means for moving a piston member in a cylinder that is connected at each end thereof to a first and second end cap section. The piston rod means is movably supported in and extends outwardly from one of the end cap sections.

Linkage means is connected to the piston rod means for effecting axial longitudinal movement of the piston rod means in first and second pumping directions with respect to the end cap sections. Manually operable handle means is connected to the linkage means for movement inwardly toward and outwardly away from the piston/cylinder assembly to thereby displace the piston rod means in the first and second pumping directions. Support means maintains the axial longitudinal alignment of the piston rod means during its movement within the cylinder.

The first and second end cap sections of the liquid pumping assembly are fixedly mounted at a spaced distance with respect to each other with the liquid pumping cylinder extending therebetween. Each end cap section includes liquid inlet means and liquid discharge means. The liquid inlet means includes first tubing means in liquid flow communication between liquid inlet chamber means located in each of the end cap sections. The liquid discharge means includes second tubing means in liquid flow communication between the liquid discharge chamber means located in each of the end cap sections.

A particular feature of the liquid pumping assembly is directed to the use of liquid inlet means for directing liquid from outside the assembly into the liquid inlet chamber means of one of the end cap sections. The other of the end cap sections includes liquid discharge means for directing liquid out of the assembly from the liquid discharge chamber means of the other of the end cap sections. The first tubing means includes a first elongate rigid tube member which connects the liquid inlet chamber means for liquid flow between the end cap sections. The second tubing means includes a second elongate rigid tube member which connects the liquid discharge chamber means for liquid flow between the end cap sections.

The support means includes bearing means for prohibiting transverse movement of the piston rod means as it axially moves through one of the end cap sections. The bearing means includes a bearing member having an outer surface, an inner surface and sealing means to preclude liquid leaking from the end cap section along the bearing member surfaces. The bearing inner surface includes a piston rod engaging portion and the sealing means includes first sealing members disposed at opposed ends of the piston rod engaging portion to preclude liquid leaking along the bearing inner surface. The sealing means includes a second sealing member disposed around the outside surface to preclude liquid leaking therealong.

Externally, the support means includes at least one elongated guide rod member fixedly connected for longitudinal movement with the piston rod means. At least one elongated guide rod member slidably extends through the two end cap sections. A connecting member has respective portions fixedly secured to the elongated guide rod member and the piston rod means extending outwardly from the end cap section.

In a specific embodiment, the support means includes two elongated guide rod members fixedly connected for longitudinal movement with the rod means and are laterally spaced from the piston rod means and from each other. The guide rod members slidably extend through the end cap sections and a connecting member fixedly secures the guide rod members to the piston rod means extending outwardly from one of the end cap sections.

Another feature of the invention is directed to the support means which include stabilizing means attached to the connecting member and mounted to prohibit lateral movement of the piston rod means when it is in an extended outward position with respect to the end cap section. The stabilizing means includes a stabilizer rod member fixedly secured at one end thereof to the connecting member and slidably supported by stabilizer rod guide means. The stabilizer rod guide means is fixedly mounted to the base means and includes a tubular section through which an outer free end section of the stabilizing rod member extends. The tubular section has sealed bearing members located at opposed ends of the tubular section and are in slidable contact with the stabilizer rod member.

Another feature of the invention is directed to the linkage means which includes coupling link means having one end portion thereof pivotably connected to the outer end of the piston rod means and another end portion pivotably connected to one end of the handle means which pivots about a handle axis of rotation. The linkage means includes tie-rod means having an inner end pivotably connected to rotate about a fixed axis of rotation and having the handle axis of rotation located at an outer end thereof whereby the handle axis of rotation rotationally moves about the fixed axis of rotation of the tie-rod means.

In a specific embodiment, the tie-rod means includes two tie-rod members located on opposing sides of the first end cap section through which the piston rod means extends. The inner ends of the tie-rod members are pivotably secured to the second end cap section and the outer ends of the tie-rod members are pivotably secured to opposing sides of the handle means which rotates about the handle axis of rotation. The handle means includes an elongated handle member secured at a fixed angular position with respect to the handle axis of rotation to cause the longitudinal movement of the piston rod means between first and second pumping positions. The handle axis of rotation constitutes the fulcrum point for the coupling link means and handle member acting in combination as lever means. The handle means includes means to adjust the fixed angular position of the handle member with respect to the handle axis of rotation.

The first end cap section has outer end edge surfaces facing a respective tie-rod member. The support means includes a bearing plate member mounted to each of the outer edge surfaces to slidably engage each tie-rod member which moves along a respective outer edge surface as the handle means effects longitudinal movement of the piston rod means.

Water tube means is operatively connected at each end thereof to the respective first and second end cap sections for causing liquid to move continuously from liquid inlet means to a liquid discharge means as the piston means moves in either the first or second pumping directions toward either the first or second end cap section, respectively. The water tube means includes a water-in tube member and a water-out tube member, each in liquid flow communication with the first and second end cap sections. Each of the end cap sections include inlet valve means and outlet valve means as described above.

The valve assembly of the invention comprises a valve member mounted for movement in a valve seat section between a closed condition and an open condition. The valve member includes a valve seat engaging surface for abutting the valve seat portion. Biasing means is effective to urge the valve seat engaging surface in a normally closed condition against the valve seat portion preventing liquid flow through the valve assembly. The valve seat portion includes a Y-shaped vertical cross-section having a recessed portion with a valve head engaging surface and a hub section with an end surface projecting outwardly away from the recessed portion. The valve seat portion has a peripheral collar portion located around the recessed portion.

In a specific embodiment of the valve assembly, the valve member includes a valve head having a valve seat engaging surface for abutting the valve head engaging surface of the recessed portion. A valve stem extends through the hub section and has an outer end which carries retainer means at a spaced distance from the hub end surface when the valve means is in a closed condition. The biasing means includes a spring member disposed between the retainer means and the valve seat portion urging the valve head against the recessed portion. The liquid flow-through section is located between the peripheral collar portion and the hub section. The valve seat portion is composed of a resilient material that does not absorb the liquid flowing through the valve assembly.

A feature of the pumping assembly is that the piston means is effective to cause the inlet valve means to open to liquid flow while the outlet valve means remains closed to liquid flow when the piston means moves within the cylinder away from each end cap section. The piston means is further effective to cause the outlet means to open to liquid flow while the inlet valve means remains closed to liquid flow when the piston means moves within the cylinder toward each end cap section. The biasing means acts on the valve stem to urge the valve seat engaging surface against the valve seat portion preventing liquid flow through the valve means until an applied force is sufficient to overcome the operation of the biasing means causing liquid to flow through the valve means.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
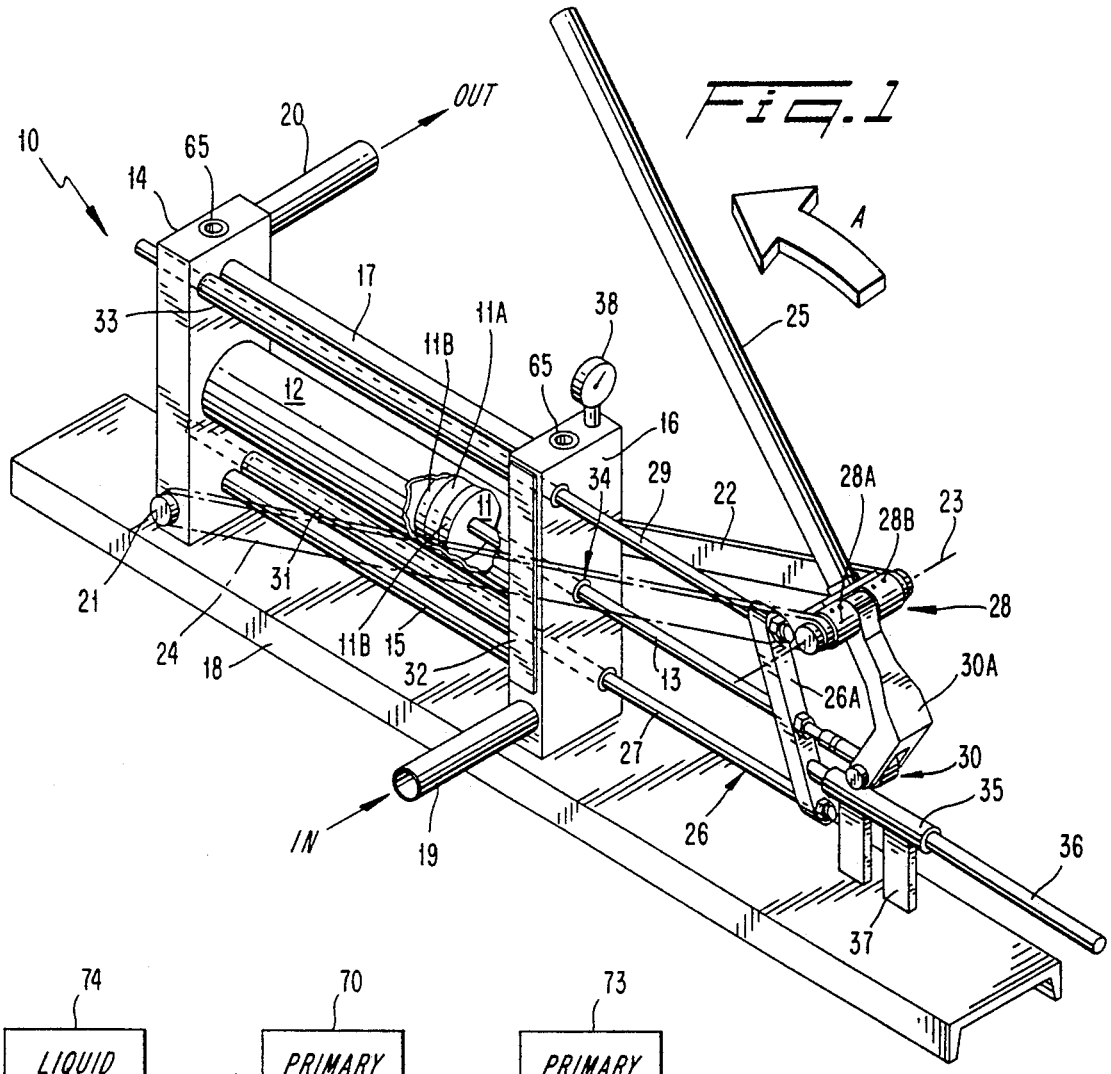
FIG. 1 is a perspective view of a pumping apparatus made in accordance with this invention.

The pumping apparatus, generally designated 10, comprises piston rod 13 connected to piston member 11 movably disposed in cylinder 12 which is connected at each end thereof to a respective first end cap section 16 and a second end cap section 14. Piston rod 13 is movably supported in a fixedly disposed bearing assembly 34 and extends outwardly from end cap section 16. In this embodiment, piston member 11 has a diameter of about 2.5 to 3.0 inches and has a wear surface 11A between piston seals 11B.

Linkage mechanism, generally designated 26, is connected to piston rod 13 to effect axial longitudinal movement of piston rod 13 in first and second pumping directions with respect to end cap sections 14 and 16. Manually operable handle 25 is connected to linkage mechanism 26 for movement inwardly toward and outwardly away from cylinder 12 to thereby displace piston 11 in the first and second pumping directions. Arrow A indicates inward movement for handle 25. Support guide rods 27, 29 and 36 are slidably mounted in bearing bushings (not shown) to maintain alignment of piston rod 13 during its longitudinal axial movement through cap section 16.

Figure 3:
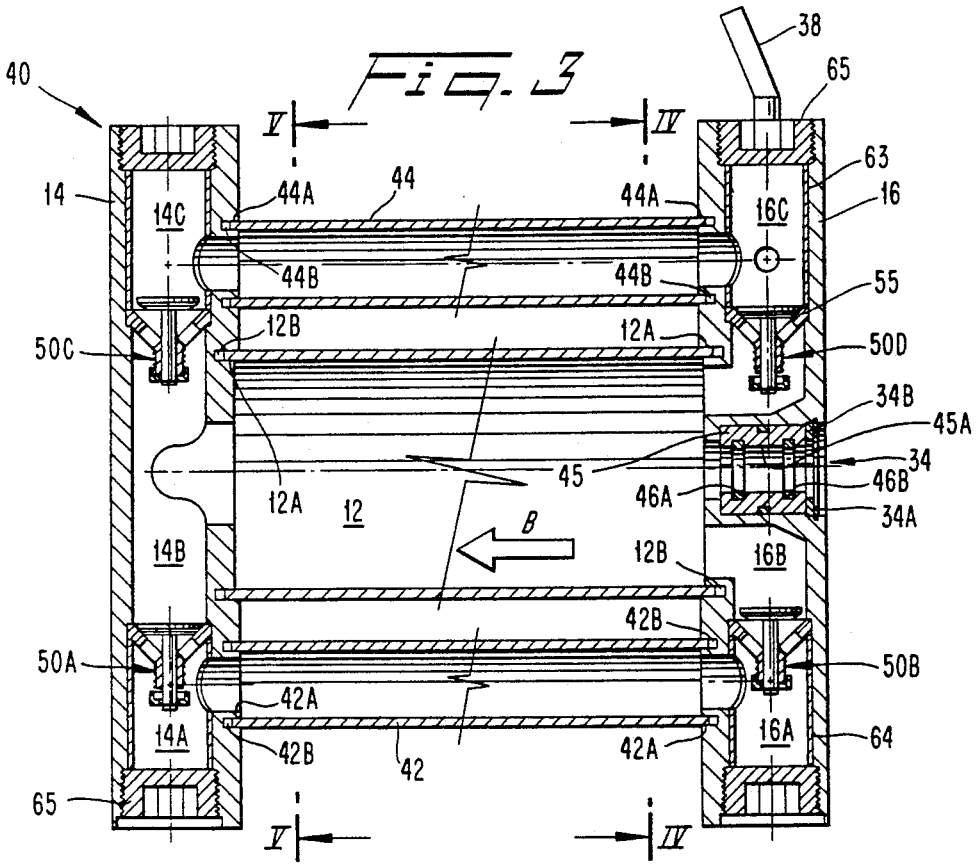
FIG. 3 is a longitudinal sectional view of a pumping assembly made in accordance with this invention.

Liquid pumping assembly 40 as shown in FIG. 3 comprises two end cap sections 14 and 16 fixedly mounted to base member 18 at a spaced distance with respect to each other with the liquid pumping cylinder 12 extending therebetween. Cylinder 12 is in liquid flow communication at each end thereof with respective first and second cap sections 14 and 16. Each cap section 14 and 16 includes a liquid inlet chamber 14A and 16A, an inner chamber 14B and 16B and a liquid discharge chamber 14C and 16C.

Inlet valve assemblies 50A and 50B are disposed between respective liquid inlet chambers 14A and 16A and inner chambers 14B and 16B of end cap sections 14 and 16. Outlet valve assemblies 50C and 50D are disposed between respective inner chambers 14B and 16B and the liquid discharge chambers 14C and 16C in end cap sections 14 and 16. As piston member 11 reciprocates back and forth within cylinder 12, diagonally disposed pairs of valve assemblies 50A, 50D and 50B, 50C alternately open and close.

As shown in FIG. 3, as piston member 11 (not shown) moves in the pumping direction of arrow B away from end cap 16 and toward end cap 14, a suction condition forms behind piston member 11 in cylinder 12 thereby causing valve assembly 50B to open thereby allowing liquid to flow into pumping cylinder 12. At the same time, a pressurized condition forms in cylinder 12 ahead of piston member 11 which is moving toward end cap section 14 thereby causing outlet valve assembly 50C to open thereby allowing liquid to flow from inner chamber 14B to discharge chamber 14C.

Figure 5:
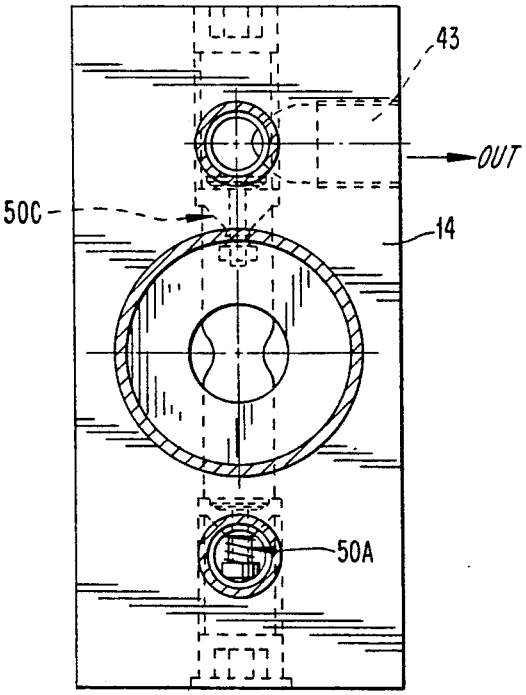
FIG. 5 is a sectional view showing the other end cap section taken along line V—V of FIG. 3.
Figure 4:
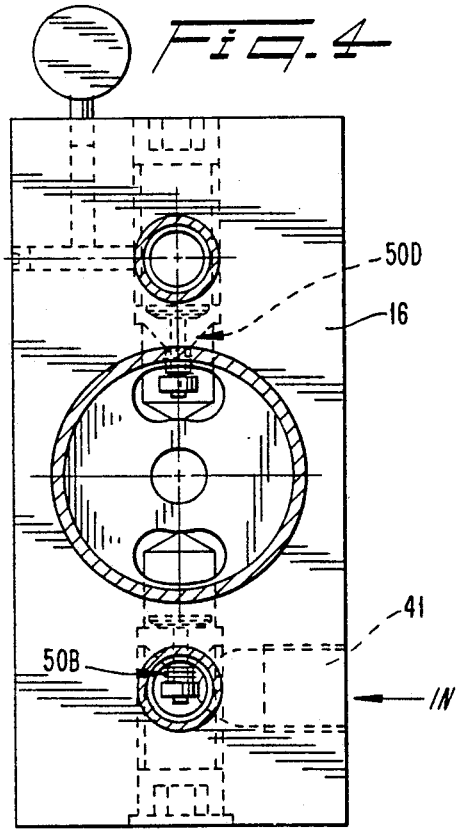
FIG. 4 is a sectional view showing an end cap section taken along IV—IV of FIG. 3.

A first water-in tube 42 is in liquid flow communication between liquid inlet chambers 14A and 16A. Water-out tube 44 is in liquid flow communication between liquid discharge chambers 14C and 16C located in respective cap sections 14 and 16. Inlet pipe 19 (FIG. 1) is inserted into the inlet opening 41 (FIG. 4) of end cap section 16. Outlet pipe 20 (FIG. 1) is inserted in outlet opening 43 (FIG. 5) in end cap section 14. A standard pressure gauge 38 disposed in operating contact with discharge chamber 16C in end cap section 16 monitors the pressure within the system into which liquid is being pumped.

Figure 2:
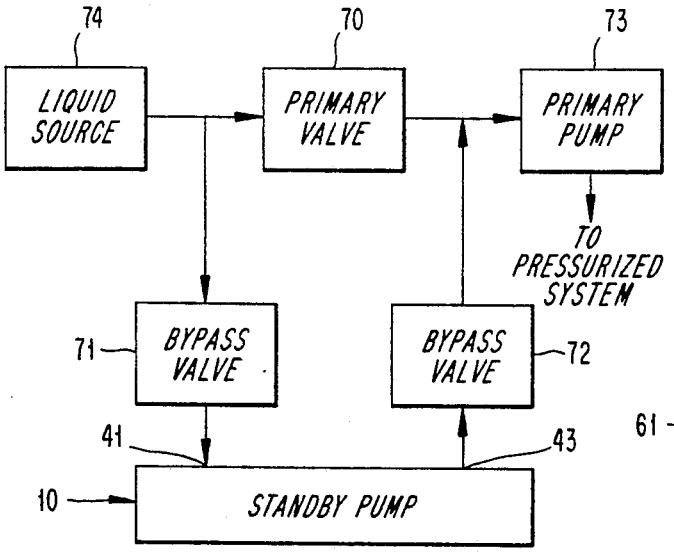
FIG. 2 is a flow diagram showing a valve system for attaching the pumping apparatus of the invention into a pressurized system.

The flow diagram of FIG. 2 shows how pump assembly 10 may be connected into a pressurized system having a normally open primary valve 70 and normally closed by pass valves 71 and 72. Primary pump 73 causes liquid to flow from liquid source 74 through pirmary valve 70 into the pressurized system. In the event that the primary pump shuts down, valve 70 is then closed and by pass valves 71 and 72 are opened thereby connecting pump inlet opening 41 and pump outlet opening 43 via inlet pipe 19 and outlet pipe 20 thereby causing liquid to flow through pump assembly 10 from liquid source 74 into the pressurized system.

Water tubes 42 and 44 are composed of brass and fit into respective annular grooves 42A and 44A (FIG. 3). Neoprene O-rings 42B and 44B disposed in grooves 42A and 44A seal the respective ends of tubes 42 and 44. Each end of brass cylinder 12 fits into an annular groove 12A having an O-ring sealing member 12B to effect a seal when end cap sections 14 and 16 are secured to base member 18. In this embodiment, end cap sections 14 and 16 are fixedly secured to base member 18 at a spaced distance with respect to each other effective to provide a positive seal at the respective ends of the cylinder 12 and water tubes 42 and 44 as shown in FIG. 3.

Figure 6:
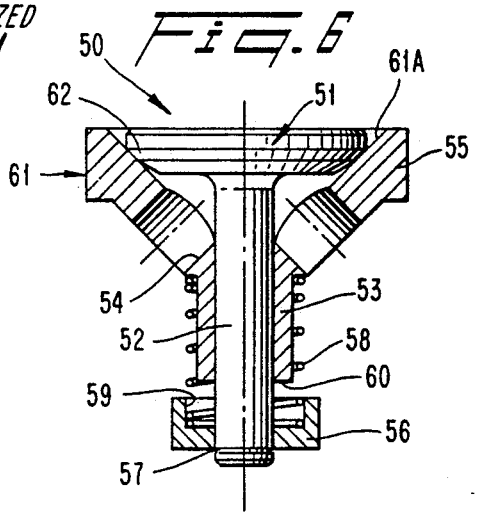
FIG. 6 is a vertical cross-sectional view of a valve assembly made in accordance with this invention.

FIG. 6 shows a valve assembly 50 including valve member 51 mounted for movement in a valve seat portion 61 between a closed condition and an open condition. Valve assembly 50 is shown in the closed condition with valve seat engaging surface 62 abutting valve seat portion 61. Stainless steel spring 58 constitutes biasing means effective to urge valve seat engaging surface 62 against valve seat portion 61 thereby preventing liquid flow through valve assembly 50.

Valve seat portion 61 has a Y-shaped vertical cross-section having a recessed portion with a valve head engaging surface 61A and hub section 53 with an end surface 60 projecting outwardly away from the recessed portion. Valve seat portion 61 includes a peripheral collar portion 55 located around the recessed portion. Apertures 54 comprise a flow-through section located between collar portion 55 and hub section 53.

Valve head 51 abuts the valve head engaging surface 61A of valve seat portion 61 and valve stem 52 projects through hub section 53. Stem 52 carries a brass retainer 56 secured by snap ring 57. Retainer 56 is located at a spaced distance from hub end surface 60 when valve assembly 50 is in a closed condition and is effective to keep spring 58 centered and limits the movement of valve head 51. In this specific embodiment, valve seat portion 61 is composed of a Duron which is a resilient material that does not absorb water flowing through valve assembly 50. Where other liquids are being pumped, different resilient materials may be used. The valve seat material is stiff enough to support the various moving parts but will allow engaging surface 62 to sink slightly into valve head engaging surface 61A of valve seat portion 61 to effect the desired seal.

Spring 58 urges valve seat engaging surface 62 against valve seat portion 61 via retainer member 56 thereby preventing liquid flow through valve assembly 50 until an applied force is sufficient to overcome the operation of spring 58 causing liquid to flow through openings 54. Sleeve members 63 and 64 abut peripheral collar portions 55 of respective valve assemblies 50B and 50D as shown to fix them in place within cap section 16. Similar sleeve members maintain valve assemblies 50A and 50C in end cap section 14 as shown.

In operation, inlet valve assemblies 50A and 50B open to liquid flow when piston member 11 moves away from each respective end cap section 14 and 16. On the other hand, piston member 11 causes outlet valve assemblies 50C and 50D to open to liquid flow when piston member 11 moves toward each respective end cap section 14 and 16.

The support means for maintaining axial alignment of piston rod 13 includes bearing assembly 34 having a bearing member 45 with an outer surface, an inner surface and sealing rings 46A, 46B and 47. Bearing member 45 includes a piston rod engaging portion 45A with sealing members 46A and 46B disposed at opposed ends thereof to preclude liquid leaking along the inner surface. The second sealing member 47 is disposed around the outer surface of bearing member 45 to preclude liquid leaking therealong. Each sealing member 46A, 46B and 47 is a Neoprene O-ring disposed in inner and annular grooves as shown. The inner surface rod engaging portion 45A is in sliding contact with piston rod 13 working to maintain the alignment thereof.

End cap sections 14 and 16 are composed of material that may be drilled to form the openings required to receive the various parts or form the chambers through which the pumped liquid flows. In this embodiment, aluminum is used for the pumping of water. The simplicity of construction minimizes the need for service. Bolts (not shown) threadlingly engage and secure cap sections 14 and 16 to base member 18 in a well known manner. Snap ring 34A and washer 34B hold bearing member 45 in place. Pipe plugs 65 fix sleeve members 63 and 64 in place thereby securing the various valve assemblies 50A, 50B, 50C and 50D as shown.

The support mechanism of pumping apparatus 10 is designed to prohibit transverse movement of piston rod 13 as it moves through end cap section 16. The support means of this embodiment includes two elongated guide rod members 27 and 29 fixedly connected for longitudinal movement with piston rod 13. Guide rod members 27 and 29 are laterally spaced from piston rod 13 and from each other. Guide rods 27 and 29 slidably extend through both end cap sections 14 and 16.

Tubes 31 and 33 (FIG. 1) are disposed around rods 27 and 29, respectively, and are sealed between end caps 14 and 16. A lubricant material may be disposed within tubes 31 and 33. Guide rods 27 and 29 also are in sliding contact with bearing members (not shown) disposed in end cap sections 14 and 16 to maintain alignment of rods 27, 29 and 13. Connecting member 26A fixedly secures guide rods 27 and 29 to piston rod 13.

Stabilizer rod 36 is fixedly secured at one end thereof to connecting member 26A and is slidably supported by stabilizer guide rod tube 35 through which an outer free end section of stabilizer rod member 36 extends. Sealed bearing members (not shown) are located at opposed ends of guide rod tube 35 and are in slidable contact with stabilizer rod 36. Support members 37 fixedly connect stabilizing guide rod tube 35 to base member 18 via bolts (not shown).

Coupling link member 30A has one end portion pivotally connected to the outer end of piston rod 13. A stainless steel spherical bearing is used in this specific embodiment to connect the end of piston rod 13 to coupling link member 30A. Coupling link member 30A is pivotally connected at the other end to rotate about the handle axis of rotation 23 located at the end of two tie-rod members 22 and 24 which are pivoted at the other end thereof adjacent the bottom of end cap section 14.

Tie-rod members 22 and 24 are located on opposing sides of end cap section 16 through which piston rod 13 extends. Elongated handle member 25 is secured at a fixed angular position with respect to handle axis of rotation 23 to cause the longitudinal movement of piston rod 13 between first and second pumping positions. The handle axis of rotation 23 constitutes the fulcrum point for the coupling link member 30A and handle member 25 acting in combination as a lever member. Adjustment mechanism 28 includes a pair of rings 28A having set screws 28B for fixing the angular position of handle member 25 secured to rings 28A which rotate with respect to the handle axis of rotation 23 when set screws 28B are loosened.

Plate 32 composed of a bearing material is mounted to each of the outer edge surfaces of end cap section 26 to slidably engage each tie-rod or pivot bar member 22 and 24 which move along a respective outer edge surface as handle 25 effects longitudinal movement of piston rod 13. Epoxy is used to adher plates 32 to the opposed sides of end cap section 16. Pivot bar members 22 and 24 keep all the pressure points centered on two sets of sealed ball bearings at either end thereof. As pivot bar members 22 and 24 ride up and down on bearing plates 32, the alignment of piston rod 13 is enchanced. Tie-rod members 22 and 24 hinge on hardened shoulder bolt members with bearing inserts and washers (not shown) to minimize wear.

Flexible tubing is used over inlet member 19 and outlet member 20 and is effective to withstand large vacuum and pressure conditions caused by the use of the pumping assembly made in accordance with this invention.

The pumping assembly of this invention is designed to be bolted to the floor or to the wall between studs in any home or building. With the capability of adjusting the angular position of handle member 25, the liquid pump assembly of the present invention may be used under virtually any environmental conditions. The assembly may be used to pump any kind of liquid such as petroleum products, processing and processed products in addition to water.

While the liquid pump assembly has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A pumping apparatus for use with a pressurized fluid system, said apparatus comprising:

a) a piston/cylinder assembly mounted between two laterally spaced end cap sections attached to base means, b) the piston/cylinder assembly including piston rod means and means for operating the assembly in combination with a pressurized fluid system, said piston rod means being effective to move a piston member movably disposed in a cylinder which is connected at each end thereof to a respective first and second end cap section, c) said piston rod means is movably supported in and extends outwardly from one of the end cap sections, d) linkage means connected to the piston rod means for effecting axial longitudinal movement of the piston rod means in a first pumping direction and a second pumping direction with respect to the end cap sections, e) manually operable handle means connected to the linkage means for movement inwardly toward and outwardly away from the piston/cylinder assembly to thereby displace the piston rod means in said first and second pumping directions, and f) support means for maintaining longitudinal axial alignment of the piston rod means during longitudinal axial movement thereof, g) the structural combination of said piston/cylinder assembly together with said piston rod means, said linkage means, said handle means and said support means being operable to pump fluid manually when the pumping apparatus is positioned in any angular disposition with respect to the horizontal.

2. An apparatus as defined in claim 1 wherein said support means includes bearing means for prohibiting transverse movement of the piston rod means as said piston rod means axially moves through said one of the end cap sections.

3. An apparatus as defined in claim 2 wherein said bearing means includes a bearing member having an outer surface, an inner surface and sealing means to preclude liquid from leaking from said end cap section along the bearing member surfaces.

4. An apparatus as defined in claim 3 wherein said inner surface includes a piston rod engaging portion, and said sealing means includes first sealing members disposed at opposed ends of the piston rod engaging portion to preclude liquid leaking along said inner surface.

5. An apparatus as defined in claim 4 wherein said sealing means includes a second sealing member disposed around said outer surface to preclude liquid leaking along said outer surface.

6. An apparatus as defined in claim 1 wherein said support means includes at least one elongated guide rod member fixedly connected for longitudinal movement with the piston rod means.

7. An apparatus as defined in claim 1 wherein water tube means is operatively connected at each end thereof to the respective first and second end cap sections for causing liquid to move continuously from liquid inlet means to a liquid discharge means as the piston means moves in either the first or second pumping directions toward either of the first or second end cap section, respectively.

8. An apparatus as defined in claim 7 wherein said water tube means includes a water-in tube member and a water-out tube member each in liquid flow communication with said first and second end cap sections, each said end cap section includes inlet valve means and outlet valve means, said inlet valve means of each respective end cap section being effective to open allowing inlet liquid flow to said piston cylinder when the piston member causes a suction condition in the cylinder behind the piston member as the piston member moves in a pumping direction away from the respective end cap section containing said open inlet valve means, and said outlet valve means of each respective end cap section being effective to open allowing outlet liquid flow from said piston cylinder when the piston member causes a pressurized condition in the cylinder ahead of the piston member as the piston member moves in a pumping direction toward the respective end cap section containing said open outlet valve means.

9. A pumping apparatus for use with a pressurized system, said apparatus comprising:

a) a piston/cylinder assembly mounted between two laterally spaced end cap sections attached to base means, said end cap sections including spring-loaded valve means, b) the piston/cylinder assembly including piston rod means for moving a single piston member movably disposed in a cylinder which is connected at each end thereof to a respective first and second end cap section, c) said piston rod means is movably supported in and extends outwardly from one of the end cap sections, d) linkage means connected to the piston rod means for effecting axial longitudinal movement of the piston rod means in a first pumping direction and a second pumping direction with respect to the end cap sections, e) manually operable handle means connected to the linkage means for movement inwardly toward and outwardly away from the piston/cylinder assembly to thereby displace the piston rod means in said first and second pumping directions, f) support means for maintaining longitudinal axial alignment of the piston rod means during longitudinal axial movement thereof, g) said support means including two elongated guide rod members which slidably extend through the two end cap sections and are laterally spaced from the piston rod means, and h) a single connecting member has respective portions fixedly secured to said elongated guide rod members and said piston rod means which extend outwardly in the same direction as the guide rod member from the connecting member and said end cap section for longitudinal movement of the guide rod members with the piston rod means which movement operates in concert with the spring-loaded valve means to pump fluid manually when the pumping apparatus is positioned in any angular disposition with respect to the horizontal.

10. An apparatus as defined in claim 7 wherein there are two elongated guide rod members fixedly connected for longitudinal movement with the piston rod means, said guide rod members being laterally spaced from the piston rod means and from each other and extending outwardly in the same direction from the connecting member.

11. An apparatus as defined in claim 10 wherein said guide rod members slidably extend through the end cap sections, and a connecting member fixedly secures the guide rod members to the piston rod means extending outwardly from one of the end cap sections.

12. A pumping apparatus for use with a pressurized system, said apparatus comprising:

a) a piston/cylinder assembly mounted between two laterally spaced end cap sections attached to base means, b) the piston/cylinder assembly including piston rod means for moving a piston member movably disposed in a cylinder which is connected at each end thereof to a respective first and second end cap section, c) said piston rod means is movably supported in and extends outwardly from one of the end cap sections, d) linkage means connected to the piston rod means for effecting axial longitudinal movement of the piston rod means in a first pumping direction and a second pumping direction with respect to the end cap sections, e) manually operable handle means connected to the linkage means for movement inwardly toward and outwardly away from the piston/cylinder assembly to thereby displace the piston rod means in said first and second pumping directions, and f) support means for maintaining longitudinal axial alignment of the piston rod means during longitudinal axial movement thereof, g) said support means includes two elongated guide rod members fixedly connected for longitudinal movement with the piston rod means, h) said guide rod members being laterally spaced from the piston rod means and from each other and slidably extend through the end cap sections, and i) a connecting member fixedly secures the guide rod members to the piston rod means extending outwardly form one of the end cap sections, j) said support means including stabilizing means attached to the connecting member and mounted to prohibit lateral movement of the piston rod means when the piston rod means is in an extended outward position with respect to said one of the end cap section.

13. An apparatus as defined in claim 12 wherein the stabilizing means includes a stabilizer rod member fixedly secured at one end thereof to the connecting member and slidably supported by stabilizer rod guide means.

14. An apparatus as defined in claim 11 wherein said stabilizer rod guide means is fixedly mounted to said base means and includes a tubular section through which an outer free end section of the stabilizer rod member extends, said tubular section having sealed bearing members located at opposed ends of the tubular section and being in slidable contact with said stabilizer rod member.

15. An apparatus as defined in claim 1 wherein the linkage means includes coupling link means having one end portion pivotably connected to the outer end of the piston rod means and another end portion pivotably connected to one end of the handle means which pivots about a handle axis of rotation, the linkage means includes tie rod means having an inner end pivotably connected to rotate about a fixed axis of rotation and having the handle axis of rotation located at an outer end thereof whereby the handle axis of rotation rotationally moves about the fixed axis of rotation of the tie rod means.

16. An apparatus as defined in claim 15 wherein the tie rod means includes two tie rod members located on opposing sides of the first end cap section through which the piston rod means extends.

17. A pumping apparatus for use with a pressurized system, said apparatus comprising:

a) a piston/cylinder assembly mounted between two laterally spaced end cap sections attached to base means, b) the piston/cylinder assembly including piston rod means for moving a piston member movably disposed in a cylinder which is connected at each end thereof to a respective first and second end cap section, c) said piston rod means is movably supported in and extends outwardly from one of the end cap sections, d) linkage means connected to the piston rod means for effecting axial longitudinal movement of the piston rod means in a first pumping direction and a second pumping direction with respect to the end cap sections, e) manually operable handle means connected to the linkage means for movement inwardly toward and outwardly away from the piston/cylinder assembly to thereby displace the piston rod means in said first and second pumping directions, and f) support means for maintaining longitudinal axial alignment of the piston rod means during longitudinal axial movement thereof, g) the linkage means includes coupling link means having one end portion pivotably connected to the outer end of the piston rod means and another end portion pivotably connected to one end of the handle means which pivots about a handle axis of rotation, h) the linkage means includes tie rod means having an inner end pivotably connected to rotate about a fixed axis of rotation and having the handle axis of rotation located at an outer end thereof whereby the handle axis of rotation rotationally moves about the fixed axis of rotation of the tie rod means, i) the tie rod means includes two tie rod members located on opposing sides of the first end cap section through which the piston rod means extends, and j) the inner ends of the tie rod members are pivotably secured to the second end cap section and the outer ends of the tie rod members are pivotably secured to opposing sides of the handle means which rotates about the handle axis of rotation.

18. An apparatus as defined in claim 17 wherein the handle means includes an elongated handle member secured at a fixed angular position with respect to the handle axis of rotation to cause the longitudinal movement of the piston rod means between the first and second pumping positions, said handle axis of rotation constituting the fulcrum point for the coupling link means and handle member acting in combination as lever means.

19. An apparatus as defined in claim 18 wherein the handle means includes means to adjust the fixed angular position of the handle member with respect to the handle axis of rotation.

20. An apparatus as defined in claim 17 wherein the first end cap section has outer edge surfaces facing a respective tie rod member, and said support means includes a bearing plate member mounted to each of said outer edge surfaces to slidably engage each tie rod member which moves along a respective said outer edge surface as the handle means effects longitudinal movement of the piston rod means.

21. A liquid pumping assembly comprising:

a) piston means mounted for reciprocating movement within a liquid pumping cylinder, b) said cylinder being in liquid flow communication at each end thereof with a respective first and second end cap section, c) each said end cap section including liquid inlet means, inner chamber means and liquid discharge means, said the liquid inlet means at one of said end cap sections including means for operating the pumping assembly in combination with a pressurized fluid system, d) inlet valve means disposed between the liquid inlet means and the inner chamber means of each end cap section, e) outlet valve means disposed between the inner chamber means and the liquid discharge means of each end cap section, f) biassing means for maintaining the inlet and outlet valve means in a normally closed condition when the pumping assembly is connected to a pressurized liquid system, and g) means for reciprocating the piston means within the cylinder being effective together with said valve means, biassing means and piston means to produce a substantially continuous flow of liquid when the pumping assembly is positioned in any angular disposition with respect to the horizontal, h) each said inlet valve means being effective to open allowing inlet liquid flow to said pumping cylinder when the piston mean causes a suction condition in the cylinder behind the piston means as the piston means moves in a pumping direction away from the respective end cap section containing said open inlet valve means, i) each said outlet valve means being effective to open allowing outlet liquid flow from said pumping cylinder when the piston means causes a pressurized condition in the cylinder ahead of the piston means as the piston means moves in a direction toward the respective end cap section containing said open outlet valve means.

22. An assembly is defined in claim 21 wherein said first and second end cap sections are fixedly mounted at a spaced distance with respect to each other with the liquid pumping cylinder extending therebetween, each end cap section includes liquid chamber means and liquid discharge means, said liquid inlet means includes first tubing means in liquid flow communication between the liquid inlet chamber means located in each said end cap section, and said liquid discharge means includes second tubing means in liquid flow communication between the liquid discharge chamber means located in each said end cap section.

23. An assembly as defined in claim 22 wherein linkage means is pivotably coupled at one end thereof to an outer end of the piston means and secured at the other end thereof with the handle means to rotate about a handle axis of rotation, the linkage means includes tie rod means having an inner end pivotably connected to rotate about a fixed axis of rotation and having the handle axis of rotation located at an outer end thereof whereby the handle axis of rotation rotationally moves about the fixed axis of rotation of the tie rod means.

24. An assembly as defined in claim 23 wherein the tie rod means includes two tie rod members located on opposing sides of the first end cap section through which the piston rod means extends.

25. An assembly as defined in claim 22 wherein one of the end cap sections includes liquid inlet means for directing liquid from outside the assembly into the liquid inlet chamber means of said one of the end cap sections, the other of the end cap sections includes liquid discharge means for directing liquid out of the assembly from the liquid discharge chamber means of said other of the end cap sections, said first tubing means includes a first elongate rigid tube member which connects said liquid inlet chamber means for liquid flow between said end cap sections, and said second tubing means includes a second elongate rigid tube member which connects said liquid discharge chamber means for liquid flow between said end cap sections.

26. An assembly as defined in claim 22 wherein said means for reciprocating the piston means includes drive means and piston rod means connected at one end thereof to the piston means, said piston rod means extending through one of the end cap sections, the other end of said piston rod means being adapted to connect to said drive means for effecting axial longitudinal movement of the piston rod means between an inward position and outward position with respect to the cylinder.

27. An assembly as defined in claim 26 wherein said drive means includes manually operable handle means connected to linkage means coupled for inward and outward movement with respect to said cylinder thereby effecting the reciprocating of the piston means within the pumping cylinder.

28. An assembly as defined in claim 27 wherein aid linkage means is pivotably coupled at one end thereof to an outer end of the piston means and secured at the other end thereof with the handle means to rotate about a handle axis of rotation, said handle axis of rotation being a lever fulcrum point whereby the piston rod means moves outwardly from the end cap section when the handle means moves inwardly and moves inwardly toward the end cap section when the handle means moves outwardly.

29. An assembly as defined in claim 27 wherein said piston rod means includes a piston rod member having an outer free end coupled to the linkage means, said drive means includes support means for maintaining longitudinal axial alignment of the piston rod member during axial longitudinal movement thereof.

30. An assembly as defined in claim 29 wherein said support means includes bearing means for prohibiting transverse movement of the piston rod means as said piston rod means longitudinally moves through said end cap section.

31. An assembly as defined in claim 29 wherein said support means includes at least one elongated guide rod member fixedly connected for longitudinal movement with the piston rod means.

32. An assembly as defined in claim 31 wherein said at least one elongated guide rod member slidably extends through the two end cap sections, and a connecting member has respective portions fixedly secured to said elongated guide rod member and said piston rod means extending outwardly from said end cap section.

33. An assembly as defined in claim 31 wherein there are two elongated guide rod members fixedly connected for longitudinal movement with the piston rod means, said guide rod members being laterally spaced from the piston rod means and from each other.

34. An assembly as defined in claim 33 wherein said guide rod members slidably extend through the end cap sections, and a connecting rod member fixedly secures the guide rod members to the piston rod means extending outwardly from one of the end cap sections.

35. An assembly as defined in claim 22 wherein said piston means is effective to cause said inlet valve means to open to liquid flow while the outlet valve means remains closed to liquid flow when the piston means moves within said cylinder away form each said end cap section, said piston means being effective to cause said outlet means to open to liquid flow while the inlet valve means remains closed to liquid flow when the piston means moves within the cylinder toward each said end cap section.

36. A liquid pumping assembly comprising:

a) piston means mounted for reciprocating movement within a liquid pumping cylinder, b) said cylinder being in liquid flow communication at each end thereof with a respective first and second end cap section, c) each said end cap section including liquid inlet means, inner chamber means and liquid discharge means, d) inlet valve means disposed between the liquid inlet means and the inner chamber means of each end cap section, e) outlet valve means disposed between the inner chamber means and the liquid discharge means of each end cap section, f) biassing mans for maintaining the inlet and outlet valve means in a normally closed condition, and g) means for reciprocating the piston means within the cylinder, h) each said inlet valve means being effective to open allowing inlet liquid flow to said pumping cylinder when the piston means causes a suction condition in the cylinder behind the piston means as the piston means moves in a pumping direction away from the respective end cap section containing said open inlet valve means, i) each said outlet valve means being effective to open allowing outlet liquid flow from said pumping cylinder when the piston means causes a pressurized condition in the cylinder ahead of the piston means as the piston means moves in a direction toward the respective end cap section containing said open outlet valve means, j) said first and second end cap sections are fixedly mounted at a spaced distance with respect to each other with the liquid pumping cylinder extending therebetween, k) each end cap section including liquid inlet chamber means and liquid discharge chamber means, l) said liquid inlet means including first tubing means in liquid flow communication between the liquid inlet chamber means located in each said end cap section, m) said liquid discharge means including second tubing means in liquid flow communication between the liquid discharge chamber means located in each said end cap section, n) said means for reciprocating the piston means including drive means and piston rod means connected at one end thereof to the piston means, o) said piston rod means extending through one of the end cap sections, p) the other end of said piston rod means being adapted to connect to said drive means for effecting axial longitudinal movement of the piston rod means between an inward position and outward position with respect to the cylinder, g) said drive means including manually operable handle means connected to linkage means coupled for inward and outward movement with respect to said cylinder thereby effecting the reciprocating of the piston means within the pumping cylinder, r) said piston rod means including a piston rod member having an outer free end coupled to the linkage means, s) said drive means including support means for maintaining longitudinal axial alignment of the piston rod member during axial longitudinal movement thereof, t) said support means including two elongated guide rod members fixedly connected for longitudinal movement with the piston rod means, u) said guide rod members being laterally spaced from the piston rod means and from each other, v) said guide rod members slidably extend through the end cap sections, and w) a connecting rod member fixedly secures the guide rod members to the piston rod means extending outwardly from one of the end cap sections, x) said support means including stabilizing means attached to the connecting member and mounted to prohibit lateral movement of the piston rod means when the piston rod means is in an extended outward position with respect to the end cap section.

37. An assembly as defined in claim 36 wherein the stabilizing means includes a stabilizer rod member fixedly secured at one end thereof to the connecting member and slidably supported by rod guide means.

38. An assembly as defined in claim 37 wherein said stabilizer rod guide means is fixedly mounted to said base means and includes a tubular section through which an outer free end section of the stabilizer rod member extends, said tubular section having sealed bearing members located at opposed ends of the tubular section and being in slidable contact with said stabilizer rod member.

39. A liquid pumping assembly comprising:

a) piston means mounted for reciprocating movement within a liquid pumping cylinder, b) said cylinder being in liquid flow communication at each end thereof with a respective first and second end cap section, c) each said end cap section including liquid inlet means, inner chamber means and liquid discharge means, d) inlet valve means disposed between the liquid inlet means and the inner chamber means of each end cap section, e) outlet valve means disposed between the inner chamber means and the liquid discharge means of each end cap section, f) biassing means for maintaining the inlet and outlet valve means in a normally closed condition, and g) means for reciprocating the piston means within the cylinder, h) each said inlet valve means being effective to open allowing inlet liquid flow to said pumping cylinder when the piston means causes a suction condition int he cylinder behind the piston means as the piston means moves in a pumping direction away from the respective end cap section containing said open inlet valve means, i) each said outlet valve mans being effective to open allowing outlet liquid flow from said pumping cylinder when the piston means causes a pressurized condition in the cylinder ahead of the piston means as the piston means moves in a direction toward the respective end cap section containing said open outlet valve means, j) said first and second end cap sections are fixedly mounted at a spaced distance with respect to each other with the liquid pumping cylinder extending therebetween, k) each end cap section including liquid inlet chamber means and liquid discharge chamber means, l) said liquid inlet means including first tubing means in liquid flow communication between the liquid inlet chamber means located in each said end cap section, m) said liquid discharge means including second tubing means in liquid flow communication between the liquid discharge chamber means located in each said end cap section, and n) linkage means pivotably coupled at one end thereof to an outer end of the piston means and secured at the other end thereof with the handle means to rotate about a handle axis of rotation, o) the linkage means including tie rod means having an inner end pivotably connected to rotate about a fixed axis of rotation and having the handle axis of rotation located at an outer end thereof whereby the handle axis of rotation rotationally moves about the fixed axis of rotation of the tie rod means, p) the tie rod means including two tie rod members located on opposing sides of the first end cap section through which the piston rod means extends, g) the inner ends of the tie rod members are pivotably secured to the second end cap section and the outer ends of the tie rod members are pivotably secured to opposing sides of the handle means which rotates about the handle axis of rotation.

40. An assembly as defined in claim 39 wherein the handle means includes an elongated handle member secured at a fixed angular position with respect to the handle axis of rotation to cause the longitudinal movement of the piston rod means between the first and second pumping positions, said handle axis of rotation constituting the fulcrum point for coupling link means and the handle member acting in combination as lever means.

41. An assembly as defined in claim 40 wherein the handle means includes means to adjust the fixed angular position of the handle member with respect to the handle axis of rotation.

42. An assembly as defined in claim 39 wherein the first end cap section ha outer edge surfaces facing a respective tie rod member, and said support means includes a bearing plate member mounted to each of said outer edge surfaces to slidably engage each tie rod member which moves along a respective said outer edge surface as the handle means effects longitudinal movement of the piston rod means.

43. A liquid pumping assembly comprising:

a) piston means mounted for reciprocating movement within a liquid pumping cylinder, b) said cylinder being in liquid flow communication at each end thereof with a respective first and second end cap section, c) each said end cap section including liquid inlet means, inner chamber means and liquid discharge means, d) inlet valve means disposed between the liquid inlet means and the inner chamber means of each end cap section, e) outlet valve means disposed between the inner chamber means and the liquid discharge means of each end cap section, f) biassing means for maintaining the inlet and outlet valve means in a normally closed condition, and g) means for reciprocating the piston means within the cylinder, h) each said inlet valve means being effective to open allowing inlet liquid flow to said pumping cylinder when the piston means causes a suction condition in the cylinder behind the piston means as the piston means moves in a pumping direction away from the respective end cap section containing said open inlet valve means, i) each said outlet valve means being effective to open allowing outlet liquid flow from said pumping cylinder when the piston means causes a pressurized condition in the cylinder ahead of the piston means as the piston means moves in a direction toward the respective end cap section containing said open outlet valve means, j) said inlet and outlet valve means in each said end cap section including a valve member and a valve seat portion having a liquid flow-through section, and k) said valve seat portion is composed of a resilient material that does not absorb the liquid flowing through the valve means, l) said valve member is engagingly biassed with the valve seat portion to prevent liquid flow through the valve means, m) each said valve member including a valve head and a valve stem, n) each said valve head including a valve seat engaging surface for abutting against a respective valve seat portion, o) said biassing means acts on said valve stem which extends through the valve seat portion and is thereby effective to urge the valve seat engaging surface against the valve seat portion preventing liquid flow through the valve means until an applied force is sufficient to overcome the operation of the biassing means causing liquid flow through the valve means.

44. An assembly as defined in claim 43 wherein each said valve seat portion includes a Y-shaped vertical cross-section having a recessed portion with a valve head engaging surface and a hub section with an end surface projecting outwardly away from the recessed portion, said valve stem extends through the hub section and has an outer end which carries retainer means at a spaced distance from said hub end surface when the valve means is in a closed condition, said biassing means includes a spring member disposed between the retainer mans and the valve seat portion urging the valve head against the valve seat recessed portion.

45. An assembly as defined in claim 43 wherein the valve seat portion has a peripheral collar portion, and each said end cap section includes sleeve means which abut the peripheral collar portion of each valve means to fix said valve means in place within said end cap section.

46. An assembly as defined in claim 45 wherein the liquid flow-through section is located between the peripheral collar portion and the hub section.

47. A valve assembly comprising:

a) a valve member mounted for movement in a valve seat section between a closed condition and an open condition, b) said valve member including a valve seat engaging surface for abutting against the valve seat portion, and c) biassing means effective to urge the valve seat engaging surface against the valve seat portion preventing liquid flow through the valve assembly, d) said valve seat portion includes a Y-shaped vertical cross-section having a recessed portion with a valve head engaging surface and a hub section with an end surface projecting outwardly away from the recessed portion, e) the valve seat portion including a peripheral collar portion located around the recessed portion and being composed of a resilient material that does not absorb the liquid flowing through the valve assembly.

48. An assembly as defined in claim 47 wherein said valve member includes a valve head and a valve stem, said valve head includes a valve seat engaging surface for abutting against the valve head engaging surface of the recessed portion, said valve stem extends through the hub section and includes an outer end which carries retainer means at a spaced distance from said hub end surface when the valve means is in a closed condition, said biassing means includes a spring member disposed between the retainer means and the valve seat portion urging the valve head against the valve seat recessed portion.

49. An assembly as defined in claim 48 wherein the liquid flow-through section is located between the peripheral collar portion and the hub section.

* * * * *